US005333337A

United States Patent [19]

Markley

[11] Patent Number: 5,333,337

[45] Date of Patent: Aug. 2, 1994

[54] APPARATUS FOR REMOVING A DEPOSIT OF CHEWING GUM FROM AN UNDERLYING SURFACE

[76] Inventor: Jim Markley, 4597 Westridge Dr., Oceanside, Calif. 92056

[21] Appl. No.: 44,740

[22] Filed: Apr. 12, 1993

[51] Int. Cl.[5] ..... A46B 13/04

[52] U.S. Cl. ..... 15/29; 15/28

[58] Field of Search ..... 15/28, 29, 50.1, 49.1, 15/320

[56] References Cited

U.S. PATENT DOCUMENTS

| | | | |
|---|---|---|---|
| 1,299,785 | 4/1919 | Sartor | 15/29 |
| 2,284,213 | 5/1942 | Karas | 15/29 |
| 4,208,753 | 6/1980 | Lewis | 15/29 |

*Primary Examiner*—Edward L. Roberts
*Attorney, Agent, or Firm*—John J. Murphey

[57] ABSTRACT

An apparatus for removing a deposit of gum or other sticky substance from a carpet or other flat surface including in combination, a body adapted for upright use and terminated by spaced-apart top and bottom ends, an electric drive motor including a rotatable drive shaft mounted in the lower half of the body to create a low center of gravity to the upright body, a flat bottom brush interconnected the drive shaft and extending below the lower body terminal end, a fluid reservoir for holding an inventory of liquid gum remover attached to the body including a conduit extending toward the brush and device for delivering a controllable charge of liquid to the deposit, handle device extending outward from the upper half of the body to manipulate the body in upright position over the deposit, including device for energizing the motor to spin the brush, and a sleeve slidably mounted coaxial with the bottom end of the body and arranged to extend outward and beyond the brush, having a planar bottom parallel to the plane of the brush and biased to extend beyond the brush, to contact the carpet about the deposit, as the body is lowered and the rotating brush and fluid cooperate to remove the deposit, to contain the washing action within the confines thereof.

20 Claims, 1 Drawing Sheet

APPARATUS FOR REMOVING A DEPOSIT OF CHEWING GUM FROM AN UNDERLYING SURFACE

BACKGROUND OF THE INVENTION

1. Field of the Invention

This invention pertains to the field of carpet and floor cleaning implements. More particularly, it pertains to an electric powered tool for removing deposits of chewing gum and other sticky deposits from carpets and floors such as is encountered in movie theaters, restaurants and the like.

2. Description of the Prior Art.

In movie theaters, hotels, restaurants, night clubs and other such places where the public congregate, it is common to see places where chewing gum and other sticky substances have been dropped onto the carpet and "walked" into the nap. Despite best efforts and good manners, people spill and drop things and, before they can be picked up or wiped up, other people either purposely or by accident step on the deposit resulting in spreading it outward and driving it into the nap of the carpet or over the surface of tile or linoleum floors. While this may be a nuisance to some, to the owners and proprietors of such places such is a far more serious problem. Without removing the deposit, the carpet will rapidly deteriorate as the substance accretes other dirt and debris that will cut or break carpet backing the longer it is walked upon. Carpeting represents a sizeable capital investment and its repair or replacement can represent an unwanted cost of operation.

There currently is no powered device for removing these deposits, The present practice for removing gum deposits from carpets is to pour a small amount of liquid gum remover or other solubilizing liquid onto the deposit and scratch the gum with a hooked instrument, such as a crocheting needle, to pull the nap up through the deposit while attempting to pull small chunks of the gum off the carpet. This process is very inefficient, is timed-consuming, and if attempted where a mass of people will soon pass by, such as when a movie theater lets out, could result in personal injury if someone trips over the worker. Some effort has been made to use a stiff brush but this has generally been found unsatisfactory because maneuvering the brush in back and forth strokes often spreads the size of the deposit and is otherwise just plain hard work.

There are devices in the prior art that appear useful in removing these deposits, however, upon closer examination they prove to be inadequate to do the job. U.S. Pat. No. 4,237,570 discloses a power brush apparatus comprising an elongated body with a rotating brush set at an angle at one end and a handle set at an angle at the other end including a trigger to allow water from a hose that is connected to the handle to pass down through the body and out the brush while driving the brush in rotary motion. A continuous flow of water would be required to keep the brush turning that would soon spread the wash zone of the chewing gum deposit to an undesirable size. The rotating brush is set at an angle to the handle and this would make it awkward to apply pressure to the brush against the deposit.

U.S. Pat. No. 4,208,753 discloses a floor cleaning apparatus including an elongated angled body with a handle on the top end and a rotating brush at the other end driven by an electric motor mounted on the body. A reservoir containing liquid gum remover is attached to the body and includes a trigger near the handle for charging a quantity of fluid from the reservoir along a conduit to the brush area. This device is designed especially to shampoo corners of wall-to-wall carpeting and the brush is pointed at the end to allow it to get into these tight corners. Attempts to use this brush on an open flat carpet surface would be difficult as the spinning brush would "walk" the device beyond the deposit thus failing to confine the sticky deposit to a smaller area.

U.S. Pat. No. 1,166,482 discloses a small, hand-held device powered by a spring motor at one end having a round end brush protruding from the other end and an internal reservoir of soap or other surface treating medium arranged to sculpt pieces of the medium and pass it down to the brush. While this device is usable to treat various surfaces, the round bottom brush will not provide uniform cleaning to the deposit and more pressure on the brush will cause injury to the carpet nap. In addition, the small size would require the user to squat beside the deposit which can pose a traffic hazard. To increase the size of the unit would make it top heavy as the heavy motor is at the top end and this would render it awkward to use.

What is needed therefore is a device that is able to confine the washing of the carpet to a small area so as to prevent the liquid and the gum from being moved out over other carpeting, a device that could easily be used to apply pressure directly to the deposit, but not too much pressure so as to drive the brush too deep into the nap and damage the nap or backing, and a device that may be applied directly to the deposit while standing up and in a manner that direct pressure could be applied to the deposit without having the unit squirm out from under the operator.

SUMMARY OF THE INVENTION

This invention is an electrically driven device for removing chewing gum and other sticky deposits from carpets and other surfaces quickly while confining the area of cleaning to a small area of the surface. It is designed to be readily positioned over the deposit, a small charge of cleaning liquid introduced to the deposit and a flat bottom brush set to spin to break down the deposit and remove it from the nap. A spring-driven sleeve passes down over the brush to contact the carpet to confine the washing area within the projected area of the sleeve. The confined area may thereafter easily be wiped with a rag to remove the gum remover and solubilized pieces of gum. The brush and sleeve are easily cleaned with water and the device put back in storage. By using the device in an upright position with the operator standing over or beside it, this invention can be used by unskilled labor and be moved quickly from spot-to-spot to maintain the carpet in a clean, sanitary, and aesthetically desirable condition.

This invention comprises an elongated body having an electric motor located in the lower part to give the device a low center of gravity for ease in positioning it upright over the gum deposit. The motor spins a flat bottom brush that is lowered into contact with the gum deposit and the user operates a mechanism to charge a small amount of liquid gum remover or other solubilizing liquid onto the deposit. A spring causes a shield or sleeve to lower around the brush against the carpet to confine the washing to a small area and thus control the wetting of the carpet. A switch may be employed to turn off the device if too much pressure is placed on the brush such that the nap would be damaged. At least one handle extends out from the upper part of the body to steady the unit perpendicularly over the deposit to prevent the unit from squirming or walking away from the deposit. When the gum has been solubilized the unit is lifted from the carpet and the liquid wiped up with a cloth. The brush and sleeve may be easily washed clean under a water faucet.

Accordingly, the main object of this invention is a compact unit for setting directly over a deposit of chewing gum or other sticky substance and removing it quickly and confining the washing area to the area of the deposit itself. Other objects of the invention include an apparatus wherein the pressure of brushing against the deposit may be adjusted to prevent the nap from being damaged; an apparatus where the reservoir of liquid gum remover or other solubilizing liquid is maintained integral in the unit to reduce storage needs and increase utilization efficiency of the unit; an apparatus with a low center of gravity for ease in holding over the deposit employing a flat-bottomed brush to prevent the unit from "walking" over the surface and off the deposit area; an apparatus easily manipulated over the deposit by unskilled labor; and, an apparatus for use in quickly and efficiently remove deposits from rugs.

These and other objects of the invention may be realized by reading the following Description of the Preferred Embodiment taken along with the drawings appended hereto. The scope of protection sought by the inventor may be gleaned from a fair reading of the claims that conclude this specification.

DESCRIPTION OF THE PREFERRED EMBODIMENT

Figure 1:
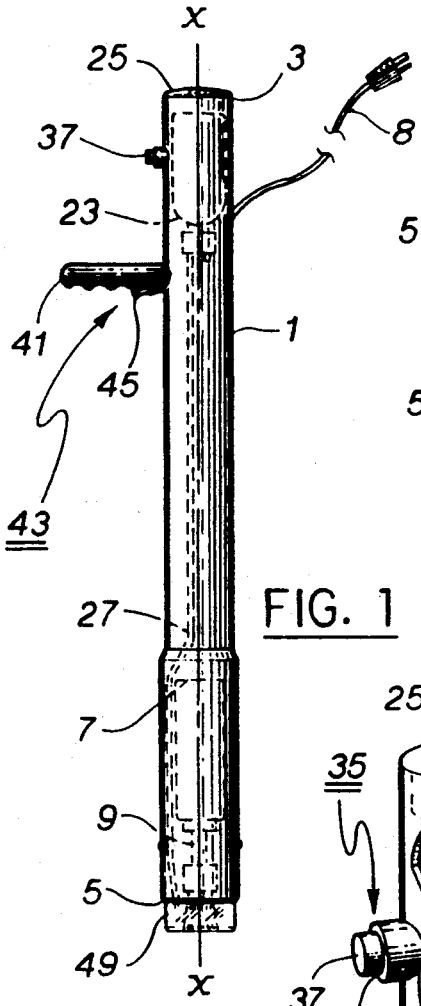
FIG. 1 is a trimetric view of the preferred embodiment of the invention.

Referring to the drawings wherein like elements are identified with like numerals throughout the five figures, the apparatus of this invention is shown in FIG. 1 to comprise a straight tubular body 1 generally about 48 inches long and about 4 to 6 inches in diameter terminated by spaced-apart top end 3 and bottom end 5. Body 1 is preferably made of light weight plastic for ease of manipulation. While the preferred shape of body 1 is tubular, other embodiments such as a square shape, triangular shape or other geometric or non-geometric cross-sectional shape are possible and are contemplated herein.

Figure 5:
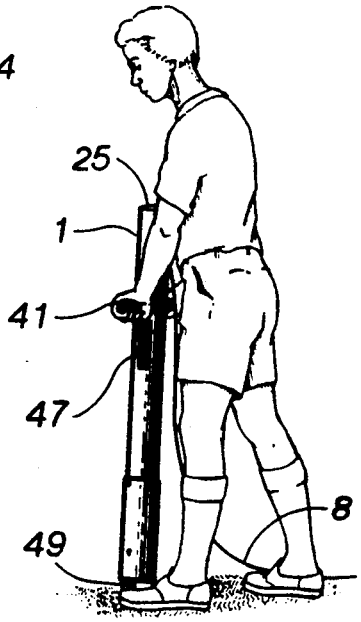

An electric drive motor 7 is mounted preferably coaxially or centrally in the lower portion or half of body 1 with a drive shaft 9 extending therefrom down toward bottom end 5. In the preferred embodiment, motor 7 is mounted coaxially or centrally in the lower portion of body 1 and drive shaft 9 is centrally or axially located therethrough. This provides for concentrating the forces of washing along the major access x—x of body 1 However, other designs wherein shaft 9 is set off-center are contemplated within this invention. A plug ended power cord 8 extends from motor 7 to an outlet (not shown) to provide electrical energy to said motor. This arrangement of motor 7 gives body 1 a lower center of gravity for use in holding it vertically over the place to be treated as shown in FIG. 5 and is easier to be used by unskilled personnel than one that would require more sophistication in holding it centrally over the deposit.

A flat-bottomed brush 11 is interconnected to drive shaft 9 and, as shown more particularly in FIG. 2, extends below body bottom end 5. Brush 11 is made up of a central body 13 having a plurality of brush strands 15 tightly clasped therein, preferably of soft brass or stainless steel, extending downward and slightly outward therefrom to terminate in a planar surface preferably parallel to the plane formed by lower body terminal end 5. A brush shaft 17 extends centrally upward from brush body 13 for engagement with the lower end of drive shaft 9. It is preferred that the connection therebetween is of the detachable type, as is known in the art, so that brush 11 may be easily replaced when it becomes worn or filled with solubilized chewing gum or other sticky substance. For added protection, a shut-off switch 21 may be located adjacent brush shaft 17 and wired to cut power from motor 7 should too much downward pressure be exerted on brush 11. Shut-off switch 21 may be of the type already known in the art having a simple spring loaded arm extending therefrom into contact with brush body 13 so that movement of body 13 upward, denoting a certain amount of unwanted downward pressure on the brush, will move the arm and activate switch 21 to shut off motor 7.

Figure 2:
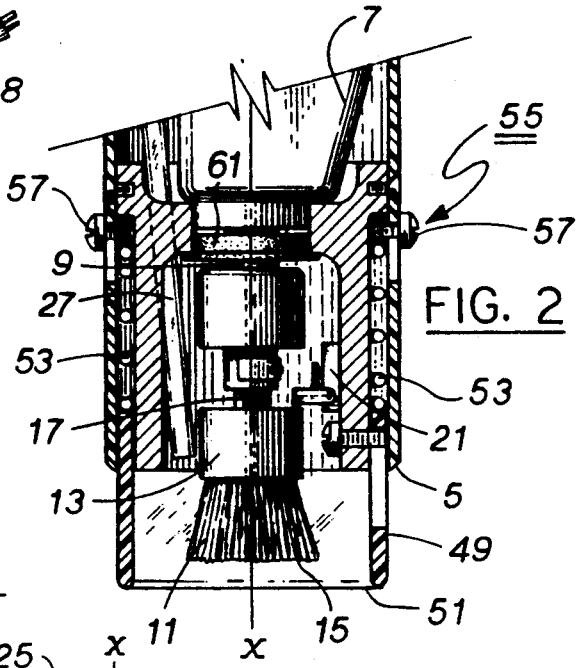
FIG. 2 is a close-up, partially sectional view of the lower part of the embodiment shown in FIG. 1 showing the brush and the sleeve with more particularity.
Figure 3:
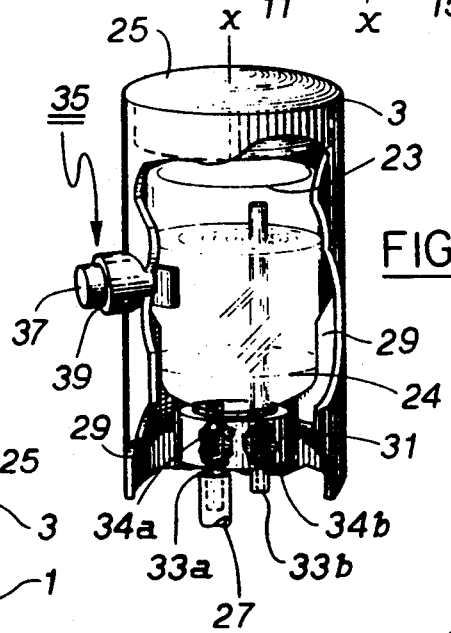
FIG. 3 is a trimetric view of the top portion of the apparatus partially broken away to show the reservoir and means for withdrawing a quantity of liquid gum remover therefrom.

As shown in FIGS. 1 and 3, a fluid reservoir 23, preferably in the form of a removable flexible plastic bottle 24, is received in body 1, and more preferably in the upper portion thereof, and even more preferably insertable in through top body end 3 that is thereafter closed with a cap 25. A flexible hollow tube 27 extends from the lower portion of upside down bottle 24 downward in body 1 to brush 11 (see FIG. 2) for transferring a charge of liquid, usually a liquid gum remover or other specially formulated chewing gum solubilizing agent, into the deposit to be mixed with the deposit by brush 11. Bottle 24 may be conveniently carried in flanges 29 and held therein by cap 25. In other embodiments, bottle 24 may be carried lower in body 1 and even carried between motor 7 and brush 11.

A connector 31 is provided preferably screwed into the top of bottle 24, and has formed therein a pair of short hollow stubs **33*a* and 33*b*. Stub 33*a* is attachable to tube 27 and includes a normally closed ball check or flapper valve 34*a* that opens to allow passage of liquid out of bottle 24 to convey the bottle contents to the brush area as hereinbefore set forth. Stub 33*b* contains a normally closed ball check or flapper valve 34*b* that allows air into bottle 24** but prevents the escape of air or fluid therefrom.

Means 35 are provided to cause reservoir 23 to expel a small quantity of liquid into flexible tube 27. As shown in FIG. 3, means 35 comprises a button 37 slidably mounted in an aperture 39 formed in body 1 that engages the side of bottle 24. By pressing inward on button 37, bottle 24 is squeezed to force some liquid from bottle 24 through stub 33*a* and valve 34*a* into flexible line 27. Release of button 37 allows bottle 24 to resume its original shape and air is drawn in through stub 33*b* and valve 34*b* to replace the volume of liquid discharged into flexible line 27. Other forms of means 35 are available and fully included herein included removing button 37 to allow one to insert their finger through aperture 39 and against bottle 24.

Figure 4:
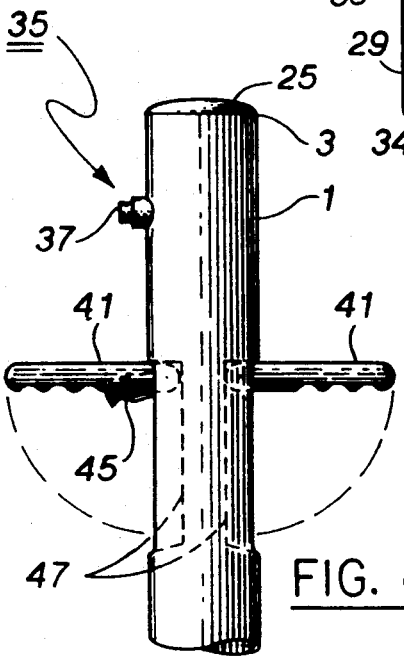
FIG. 4 is an illustrative view of another embodiment of the apparatus showing two steadying handles and their ability to be rotated into the body for easier storage; and, FIG. 5 is a trimetrlc view of the apparatus showing it being used to remove a deposit of gum from a carpet.

As shown in FIG. 1, at least one handle 41 is provided for holding the device in an upright position (see FIG. 5) that extends outward from the upper portion or half of body 1 and is arranged normal or perpendicular to the axis x—x of body 1. In the preferred embodiment, a means 43 such as a common spring loaded trigger/-switch 45 is included with handle 41 so that, while one has manipulated body 1 into an upright position over the deposit of gum, the trigger may be squeezed to cause trigger/switch 45 energize motor 7 and begin the brushing operation. In another embodiment shown in FIG. 4, two handles 41 are provided, one on each side of body 1 such as is generally found in jack hammers and other such devices, to provide more stability to the apparatus. Further, as shown in FIG. 4, in another embodiment, handles 41 may be designed to pivot downward into detents 47 when not in use so that the apparatus may be stored in a confined area without handles 41 sticking outward. Handles 41 may be shaped as pistol grips with finger detents or be merely straight elements as pictured and all such configurations are fully contemplated within the spirit and scope of this invention.

A sleeve 49 is slidably mounted coaxially at the bottom end 5 of body 1 and extends about brush 11 and beyond the ends of strands 15. Sleeve 49 terminates in a lower distal end 51 that is flat, forming a plane that is normal or perpendicular to axis x—x and parallel to the plane formed by the ends of brush 11 and spaced therebelow a short distance such as a half an inch. As shown in FIG. 2, sleeve 49 extends beyond brush 11 so that when the apparatus is set upright over a deposit as is shown in FIG. 5, sleeve 49 is the first to contact the carpet or floor. A spring 53 is connected to sleeve 49 to bias it outward beyond the end of brush 11. Because sleeve 49 extends beyond brush 11, when the unit is placed vertically upright in storage, brush 11 is held off of the underlying surface or floor and therefore the strands of brush 11 do not become bent to one side to take a permanent set as is often the case when one stores a floor brush or broom in an upright position.

Further, spring force adjustment means 55 may be provided in the form of an adjustment screws 57 as shown in FIG. 2 to vary the initial setting of spring 53 to provide more or less spring force on sleeve 49. In this manner, the apparatus may be adjusted for carpet naps of different heights similar to the settings formed in the common vacuum cleaner. In still another embodiment, the means to energize electric motor 7 may be moved from handle 41 to sleeve 49 or brush 11 so that when the apparatus is set upright over a deposit, as shown in FIG. 5, and lowered onto the deposit, motor 7 automatically turns on when brush 11 or sleeve 49 come into contact with the surface. This further reduces the duty of the user and lowers the skill needed to operate the invention.

A seal 61 is shown in FIG. 2 interposed between brush 11 and electric motor 7 to prevent any liquid or solubilized chewing gum or deposit material from working its way up into the motor or drive shaft bearings to bind the operation or short out the electrical connections. Seal 61 also allows the apparatus to be up-ended and passed under a water faucet to wash the liquid gum remover and solubilized gum from sleeve 49 and brush 11. When brush 11 becomes full of the deposit material, it may be easily removed and replaced. Sleeve 49 may also be made transparent, such as by the use of transparent material such as polycarbonate, so that the user may observe the operation of brush 11 on the deposit.

Electric motor 7 may be of the reversible type, to allow brush 11 to change its rotation from clockwise to counter-clockwise and/or vice versa to aid in removing the deposit. Also, it may be of the variable speed variety so that the rotational speed of brush 11 may be varied by changing pressure on trigger/switch 45 or some other mechanism.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. Apparatus for removing a deposit of gum or other sticky substance from a carpet or other flat surface comprising, in combination:

a) a body adapted for upright use and terminated by spaced-apart top and bottom ends;

b) an electric drive motor including a rotatable drive shaft mounted in said upright body;

c) a flat bottom brush interconnected said drive shaft and extending below said lower body terminal end;

d) a fluid reservoir for holding an inventory of liquid gum remover attached to said body including a conduit extending toward said brush and means for delivering a controllable charge of liquid to said deposit;

e) handle means extending outward form the upper half of said body to manipulate said body in upright position over the deposit, including means for energizing said motor to spin said brush; and, f) a sleeve slidably mounted coaxial with said bottom end of said body and arranged to extend outward and beyond said brush, having a planar bottom parallel to the plane of said brush and biased to extend beyond said brush, to contact the carpet about the deposit, as said body is lowered and said rotating brush and fluid cooperate to remove the deposit, to contain the washing action within the confines thereof.

2. The apparatus of claim 1 wherein said body is tubular and is light weight and straight.

3. The apparatus of claim 1 wherein said drive shaft is mounted axially in said body.

4. The apparatus of claim 1 wherein said motor is mounted coaxially in said body and said drive shaft is mounted centrally in said motor.

5. The apparatus of claim 1 wherein said flat bottom brush is detachably connected to said drive shaft.

6. The apparatus of claim 1 wherein said fluid reservoir is mounted internal said body.

7. The apparatus of claim 1 wherein said fluid reservoir is mounted internal said body at the top end thereof and said conduit means includes a flexible line extending from said reservoir to said bottom terminal end of said body.

8. The apparatus of claim 1 wherein said fluid reservoir is a flexible bottle removably mounted in the upper end of said body said means for delivering a charge of fluid therefrom includes button slidably mounted in an aperture formed in said body to engage said flexible body to expel a small quantity of liquid therefrom when being pressed inward from the outside of said body.

9. An apparatus for removing a deposit of gum from a carpet or other flat surface comprising, in combination:

a) a light-weight tubular straight body adapted for upright use and terminated by space-apart top and bottom ends;

b) an electric drive motor including a centrally located rotatable drive shaft axially mounted in the lower half of said body to create a low center of gravity to said upright tubular body;

c) a flat bottom brush detachably interconnected said drive shaft and extending below said lower body terminal end;

d) a fluid reservoir attached to said body including a conduit extending toward said brush and means for delivering a controllable charge of liquid to said deposit;

e) handle means extending outward from the upper half of said body to manipulate said body in upright position over the deposit, including means for energizing said motor to spin said brush; and, f) a sleeve slightly larger in diameter than the diameter of said brush slidably mounted coaxial with said bottom end of said body and arranged to extend outward and beyond said brush, to contact the surface on which the deposit is located and confine the gum removing operation within the confines thereof.

10. The apparatus of claim 9 wherein said fluid reservoir is mounted internal said body.

11. The apparatus of claim 9 wherein said fluid reservoir is mounted internal said body at the top end thereof and said conduit means includes a flexible line extending from said reservoir to said bottom terminal end of said body.

12. The apparatus of claim 9 wherein said fluid reservoir is a flexible bottle removably mounted in the upper end of said body and said means for delivering a charge of fluid therefrom includes a button slidably mounted in an aperture formed in said body to engage said flexible body to expel a small quantity of liquid therefrom when being pressed inward from the outside of said body.

13. The apparatus of claim 9 wherein said handle is arranged normal to the axis of said body and said means for energizing said motor includes a spring loaded trigger mounted on said handle.

14. The apparatus of claim 9 further including a seal between said brush and said motor to prevent ingress of liquid and solubilized deposit to said motor.

15. The apparatus of claim 9 wherein said motor is of the variable speed type.

16. The apparatus of claim 9 wherein said motor is reversible in direction.

17. The apparatus of claim 9 wherein said motor is a variable speed and reversible in direction.

18. The apparatus of claim 9 wherein said fluid reservoir is insertable through said top end of top body.

19. The apparatus of claim 9 wherein said handle means include two handles extending outward at an angle parallel to the main axis of said body from the upper half of said body,

20. The apparatus of claim 9 wherein said handle means further include means for rotating said handles into detents formed in said body.

* * * * *